United States Patent [19]

Kaukeinen et al.

[11] 4,125,322

[45] Nov. 14, 1978

[54] ELECTROPHOTOSENSITIVE MIGRATION IMAGING APPARATUS AND METHOD

[75] Inventors: Joseph Y. Kaukeinen; John R. Michener, both of Rochester, N.Y.

[73] Assignee: Eastman Kodak Company, Rochester, N.Y.

[21] Appl. No.: 804,046

[22] Filed: Jun. 6, 1977

[51] Int. Cl.[2] ..... G03G 17/04

[52] U.S. Cl. ..... 355/4

[58] Field of Search ..... 355/4, 3 P

[56] References Cited

U.S. PATENT DOCUMENTS 3,976,485 8/1976 Groner ..... 355/3 P X 4,023,968 5/1977 Amidon et al. ..... 355/3 P X

*Primary Examiner*—R. N. Envall, Jr.

*Attorney, Agent, or Firm*—John D. Husser

[57] ABSTRACT

Improved migration imaging techniques and apparatus utilizing a mixture of multicolor electrophotosensitive particles are achieved by exposure of the mixture, between electrodes which create a migration-inducing field, sequentially to the color separation components of the original image to be reproduced. Certain disclosed embodiments utilize exposure at spatially separated color sub-zones within an overall imaging zone to effect migration in controlled sequence, by particle type.

30 Claims, 11 Drawing Figures

ELECTROPHOTOSENSITIVE MIGRATION IMAGING APPARATUS AND METHOD

CROSS-REFERENCE TO RELATED APPLICATIONS

Reference is hereby made to commonly assigned, copending U.S. patent application Ser. No. 740,699, filed November 11, 1976 now Pat. No. 4,058,828, entitled DOCUMENT COPYING APPARATUS, in the name of John H. Ladd.

BACKGROUND OF THE INVENTION

1. Field of the Invention

The present invention relates to electrophoretic migration imaging apparatus and procedures and more particularly to improved apparatus and method for image exposure in electrophoretic migration imaging systems.

2. Description of the Prior Art

Electrophoretic migration imaging processes capable of producing polychromatic images have been extensively described in the patent literature. Early publication of these processes occurred in a series of patents by E. K. Kaprelian including U.S. Pat. No. 2,940,847 issued June 14, 1960; U.S. Pat. No. 3,100,426 issued Aug. 13, 1963; U.S. Pat. No. 3,140,175 issued July 7, 1964; and U.S. Pat. No. 3,143,508 issued Aug. 4, 1964. More recent publications relating to polychromatic, electrophoretic migration imaging processes include U.S. Pat. No. 3,383,393 to Yeh issued May 21, 1968; U.S. Pat. No. 3,384,565 to Tulagin and Carriera issued May 21, 1968 and U.S. Pat. No. 3,384,566 to Clark issued May 21, 1968.

In a typical embodiment of a single-pass, polychromatic, electrophoretic migration imaging system, images are formed by providing a suspension of electrically photosensitive particles of three different color types (each type of particle being sensitive uniquely to a particular color of light) between a transparent, electrically conductive electrode (commonly termed the "injecting electrode") and an electrode bearing an electrically insulating layer on its outer surface (commonly termed the "blocking electrode"). An electric field is applied across the two electrodes while simultaneously exposing the particles to a multicolor light image which is selectively absorbed by the particles according to light color.

As these steps are completed, selective particle migration takes place in image configuration producing complimentary images on both electrodes. While the theory of image formation is not completely understood, it is believed that the particles initially bear a charge in the imaging suspension which causes them to be attracted to the injecting electrode upon application of the electric field between the blocking and injecting electrodes. Upon exposure to activating electromagnetic radiation to which they are sensitive (i.e., of a color absorbed), the exposed particles adjacent the injecting electrode apparently undergo a change in charge polarity by exchanging charge with the injecting electrode. These particles, now bearing the same charge polarity as the injecting electrode, are repelled by it and migrate to the blocking electrode. The particles which migrate to the blocking electrode are less able to exchange charge with that electrode's insulating layer and do not therefore readily recycle to the injecting electrode. As a result, an image is formed by particle subtraction on the injecting electrode, such image being typically a photographically positive image, and a complimentary image, typically a negative or reverse image, is formed on the blocking electrode.

Such a system offers substantial advantage by allowing exposure and development of all substituents of a color image at a single exposure zone, thus eliminating the need for three color separation exposures and three separate development stations. Perhaps even more attractive is the possibility of avoiding the problems associated with registering a plurality of color separation images.

Although the potential advantages mentioned above are significant, there are also substantial problems connected with the system. Two of the most serious are (1) the difficulty in obtaining high density images via exposure at a single exposure zone and (2) the difficulty in maintaining a proper proportional deposition of the plurality of different color pigments activated in a single exposure so as to obtain an accurately color balanced reproduction of the original.

Consideration of various prior art implementations of the electrophoretic migration imaging process emphasize these problems. For example, as a means to increase "image and color quality", U.S. Pat. No. 3,719,484 discloses a special nip exposure construction which subjects the photoelectrophoretic ink to a plurality of web electrodes within a single exposure zone. U.S. Pat. Nos. 3,703,335 and 3,667,842 are representative of apparatus in which a plurality of aligned, reinforcing-imagewise-exposures are projected at separate scan zones.

U.S. Pat. Nos. 3,857,549 and 3,682,628 and British Pat. No. 1,247,465 are examples of apparatus approaches which have forgone the advantages offered by a single exposure of a tri-particle dispersion and utilize three color separation exposures of three different single color suspensions. These approaches thus choose to deal with severe registration problems rather than the density and color balance problems mentioned above. It should be noted that U.S. Pat. No. 3,857,549 avoids registration problems; however this is accomplished only by using the original to be produced in contact printing relation with an electrode of the copy apparatus. This latter approach provides certain distinct machine limitations, e.g., with respect to handling of the original and to magnification changes. All such prior art apparatus suffer from the complexity and expense of three separate imaging and development stations.

U.S. Pat. Nos. 3,649,515 and 3,663,396 disclose apparatus for controlling color balance without registration of color separation images, U.S. Pat. No. 3,663,396 by using a color television tube as the exposure source and varying the intensity of its output, and U.S. Pat. No. 3,649,515 by forming color-correcting masks with a pre-imaging and development sequence. Commonly assigned U.S. application Ser. No. 740,699, filed Nov. 11, 1976 now U.S. Pat. No. 4,058,828 discloses correction for color balance by means of selective control of the color content and intensity of three co-linear color laser beams scanned across the imaging nip. The above techniques are helpful but additional improvement in the image density, color balance and other characteristics of such systems would be desirable.

SUMMARY OF THE INVENTION

It is a purpose of the present invention to provide improved electrophoretic migration imaging apparatus and procedures.

One object of the present invention is to provide apparatus and methods which facilitate improved image density and/or color balance control in connection with image exposures of a mixture containing a plurality of differently colored photosensitive pigments.

Another object of the present invention is to provide electrophoretic migration imaging apparatus and methods which facilitate such improved image density and/or color balance control in a single-exposure-zone mode.

Yet another object of the present invention is to provide improved electrophoretic migration imaging apparatus and method which facilitate deposition of the different types of particles from a multicolor particle mixture in an imagewise pattern having discrete color layers.

Still another object of the present invention is to provide method and apparatus using spatial color separation exposures of a mixture of different-colored, photosensitive pigments at a single imaging zone to achieve improved imaging results.

The above and other advantages and objectives are accomplished in accordance with the present invention by providing a multicolor, photosensitive-particle dispersion in an imaging zone having a migration-inducing field and exposing the dispersion with the information of the multicolor image pattern to be reproduced in a predetermined color separation sequence. Thus the present invention provides means for supporting such a multicolor dispersion in such a field and means for exposing that dispersion sequentially to color-separation components of the multicolor pattern to be reproduced. The color separation exposures can be executed in a continuous system in spatially separated predetermined orders which facilitate formation of a color-layered image and other improvements, such as image density and color balance.

BRIEF DESCRIPTION OF THE DRAWINGS

The invention is hereinafter described in connection with the attached drawings which form a part hereof and in which.

DETAILED DESCRIPTION OF THE PREFERRED EMBODIMENTS

Before describing various exemplary structures and implementations of the present invention, a brief abstract discussion of certain physical mechanisms connected with the invention is believed useful.

Figure 1:
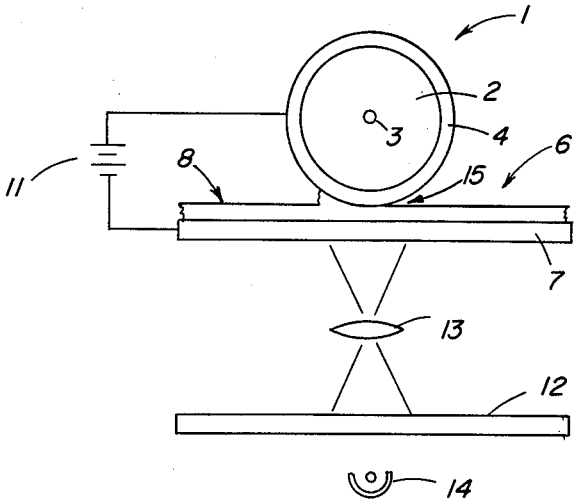
FIG. 1 PRIOR ART
FIG. 1 is a schematic view of an exemplary prior art photoelectrophoretic migration imaging apparatus.
Figure 2:
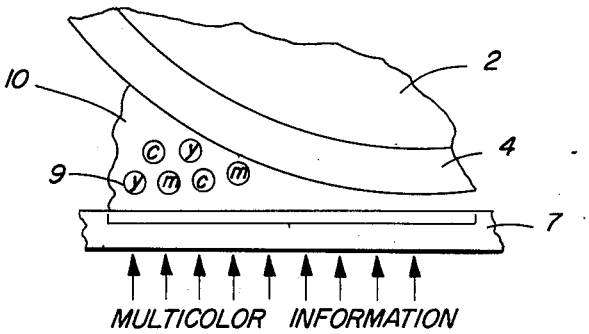
FIG. 2 PRIOR ART
FIG. 2 is an enlarged schematic view of a portion of the FIG. 1 prior art apparatus.

FIGS. 1 and 2 illustrate in a simple schematic form, an exemplary prior art system for performing photoelectrophoretic migration imaging at a single imaging station. A blocking electrode 1 includes an electrically conductive roller 2 mounted for rotation on a fixed axis 3 and has an electrically insulative peripheral layer 4. An injecting electrode 6 comprises a transparent, electrically conducting layer 7 and bears a uniform coating of imaging dispersion 8 which contains different colored electrophotosensitive particles 9 in an insulative carrier liquid 10. A source 11 of electrical potential creates a migration-inducing field between the blocking and injecting electrodes. A color original transparency 12 to be reproduced is moved in scanning relation with movement of the injecting electrode, and a lens 13 images successive portions of the original at the nip between the electrodes. A source of white light 14 is directed through the original (reflected from the original if it is opaque) and all light colors unabsorbed by each scanned portion original pass together through the injecting electrode and are imaged in the corresponding portion of the dispersion at a multicolor information zone 15 between the blocking and injecting electrodes.

In accordance with conventional subtractive color reproduction systems the different color particles in the dispersion are cyan, which absorbs and is electrically responsive to red light, magenta, which absorbs and is electrically responsive to green light, and yellow, which absorbs and is electrically responsive to blue light. Thus theoretically when, e.g., a solely red portion of the original passes the scanning station, red light strikes all the different colored particles in the portion of dispersion at the information zone; but only the cyan particles are activated, exchange charge at injecting electrode 7 and migrate to blocking electrode 4. Other particles respond similarly when the original provides solely their respective activating light. If the scanned original portion provides light of more than one color (wavelength range) e.g., if it had a bluish green portion, quantities of both yellow and magenta particles would be activated at the same time. If a portion of the original was a neutral color or white, some of all types of particles in the information zone would be activated and migrate during the same period. Thus a negative color image is formed at the blocking electrode and a positive color image remains on the injecting electrode.

The model described above assumes ideal light absorption characteristics for the particles and disregards differences in the particle migration rates and particle interactions. However, in practice, these factors are significant in obtaining a high density, properly color-balanced reproduction. For example, it has been theorized (see U.S. Pat. No. 3,881,920) that non-ideal spectral sensitivity of particles causes migration of particles in response to light of a color(s) to which they should not respond. This phenomenon can be corrected to some extent by improving the spectral sensitivity of the particles so as to be mutually exclusive and by removing from the image light, any overlap wavelengths (i.e., those to which two colors of particles are mutually responsive). However, we have discovered another inter-particle phenomenon which cannot be readily compensated by either of the foregoing techniques. Based on our tests, some of which are subsequently described, it appears that (1) the activated particles of different colors migrate at different rates and (2) the faster particles, i.e., those reaching the blocking electrode first, act as injection sites causing a charge reversal and rejection or reverse migration, of the slower migrating particles which subsequently reach the blocking electrode.

We have found that by applying the color information from the original to such a multicolor dispersion, sequentially, at discrete color information sub-zones within the overall imaging zone, these problems of particle interaction can be alleviated and/or other useful color balance effects can be implemented. Further, we have found that the sequential application of color information also provides layering, by color, of the various substituent types of color particles which form the multicolor images. It is believed that this forced layering will facilitate image renditions having better density, color separation and scatter correcting characteristics than renditions in which the various color particles are simultaneously activated.

Figure 3:
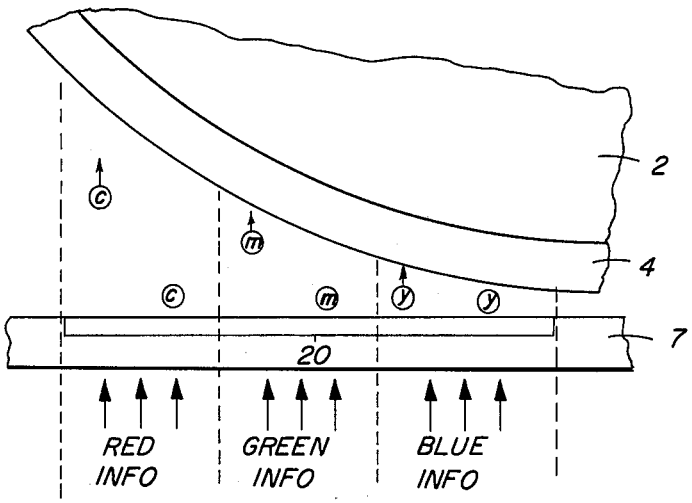
FIG. 3 is a schematic view of apparatus similar to FIGS. 1 and 2, but illustrating spatial exposure in accordance with one embodiment of the present invention.

Referring now to FIG. 3, an enlarged schematic view of a portion of an apparatus similar to that shown in FIGS. 1 and 2, but incorporating one embodiment of the present invention, is illustrated. In particular, it can be seen that the overall imaging zone 20 is subdivided into three discrete color information sub-zones denoted "RED", "GREEN" and "BLUE" instead of a single, multicolor information zone such as 15 in FIG. 2. This feature of the present invention can be implemented in a simple embodiment by placing red, green and blue light-passing filters at appropriate locations in the light path between the original and the overall imaging zone. In other embodiments, subsequently described, red, green and blue information is provided in a timed sequence.

Considering FIG. 3, at the first color information sub-zone to which each successive dispersion increment is exposed, i.e., the red zone, only the cyan particles are involved. More specifically, those cyan particles residing in a portion of the aligned dispersion increment that imagewise correspond to a "red-containing" area of the aligned original increment, migrate to blocking electrode 4 and those cyan particles that reside in a portion of the dispersion increment for which no red exists in its corresponding portion of the original increment, remain at the injecting electrode. The magenta and yellow pigments in the dispersion increment are not affected at the red information zone, regardless of the color content of the corresponding original increment. Next, the same dispersion increment, and its contiguous injecting and blocking electrode portions, move into the green information sub-zone and the magenta particles are exclusively input with green information and migrate or remain on the injecting electrode depending on the green content of the corresponding original portions. Finally the same dispersion increment and electrode portions move through the blue information sub-zone and yellow particles in the increment are exclusively activated in accordance with the blue content of corresponding original portions. For ease of illustration, the particles which might have migrated in previous sub-zones are not shown in the succeeding zones, but it will be appreciated that the previous particle migrations can occur. For example if the dispersion increment and electrode portions shown at the blue zone in FIG. 3, corresponded to an original increment having a blue-green content, magenta particles would have previously migrated during passage of the increment through the green information sub-zone. Further if that corresponding original increment contained neutral or white, magenta and cyan particles would have migrated respectively during passage through the green and red information zones.

Upon contemplation of the foregoing, two factors can be realized. First, adverse particle interaction of the type described above is obviated, since different particle types are activated for information input sequentially and previously migrated particle types at the blocking electrode will not act as injection sites to prevent proper migration of the subsequent particle types because activating radiation for the preceding particle type is not present in subsequent information zone. For example, cyan particles which have previously migrated at the red information zone will not be activated by green or blue light at subsequent information zones and thus cannot act as migration inhibiting injection sites with respect to the subsequently migrating magenta and yellow particles, i.e., those cyan particles perform as a conventional blocking layer. Second, it will be realized that the particle types, when migrating in this sequential manner, will form a layered final image, i.e., comprised of cyan, magenta and yellow stratum in that order in the example described with respect to FIG. 3, assuming a neutral density exposure.

The order and extent of each particular color information zone can be determined in accordance with the relative characteristics of the different particle types in a given dispersion. One particularly useful order of exposure of the particles has been found to be in a sequence based on relative action zones of the respective particle types "in-mixture," i.e., exposure of the particle type having the leading action zone first and so forth. As used herein in description of particle types the phrase "relative action zone" denotes somewhat equivalent features as the terms "relative photoelectrical sensitivity" or "relative speed" of particle types. However differences can exist between the independently measured relative speeds of particle types and the relative action zones of the particular types, in-mixture. Such differences may be caused by interactions between the particle types or other phenomena associated with the particular multicolor particle system involved, e.g., the relation of the particle types to the carrier liquid or to the electrodes. Therefore, we have illustrated in FIG. 4*a* one apparatus for determining the relative action zones of the particle types in the environment of intended use.

Figures 4A, 4B, 4C, 4D:
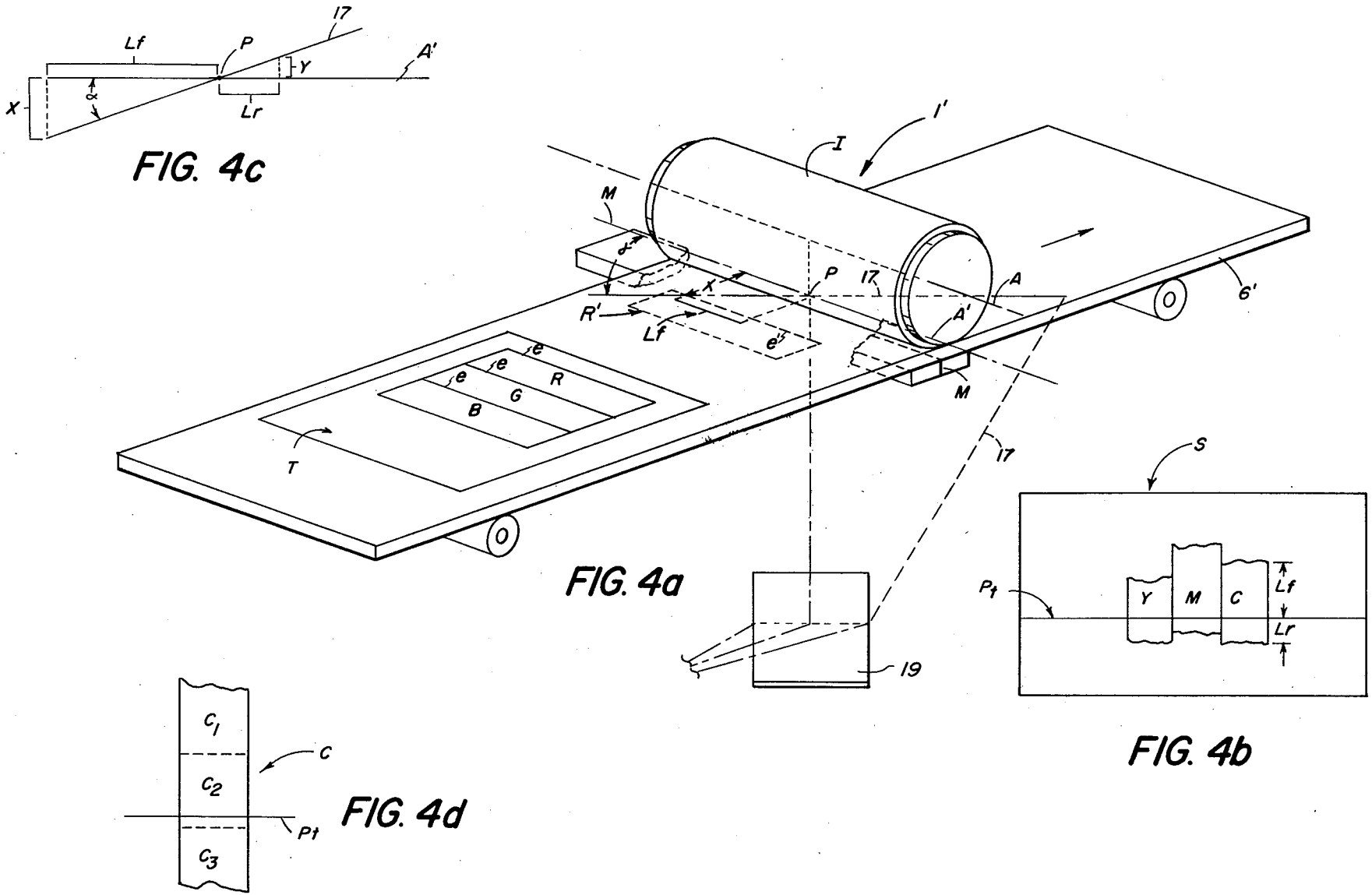
FIGS. 4*a*–4*c* are schematic views indicating apparatus and procedures for determining action zones in accordance with an aspect of the present invention.

In FIG. 4*a* an apparatus similar to that described in connection with FIG. 1 is shown comprising blocking electrode 1' and injecting electrode 6'. In the FIG. 4 test apparatus, however, a transparency T, containing red, green and blue filter sections R, G, and B moves as a test object with and beneath the injecting electrode 6' so as to pass under the resilient blocking electrode roller 1', which is rotatable on axis A and includes an insulative layer I. A narrow band or strip of white light 17 is directed from a source, not shown, via mirror 19 at a location to pass through the transparency T and injecting electrode 6' during movement beneath the blocking electrode. The light strip 17 is oriented at an angle $\alpha$ with respect to the center line A', defined by the normal projection of axis A onto the plane of electrode 6'. A transparent member is located so that an opaque mask line M contained therein is oriented in alignment with lines A and A', i.e., in the plane extending through lines A and A' and normal to the injecting electrode surface. A dispersion to be analyzed as to action zones is placed ahead of the nip between the electrodes (i.e., to the left as viewed in FIG. 4); and, with the field between the electrodes and the projection source energized, the rectangular filters on the target are moved through the imaging zone with electrode 6'. The leading edges "e" of the filter strips may be oriented parallel to the axis A as shown. Upon completion of imaging, i.e., movement of the target T through the imaging zone between the electrodes, the image formed on the layer I of electrode 1' can be transferred, e.g., using clear adhesive tape, to form a sheet S for analysis. The sheet S will contain information of the type shown in FIG. 4*b*.

FIG. 4*b* is an illustration of one possible result that might be obtained by the test procedure described above and can be analyzed as described below to determine the action zones of the particle types in the dispersion. As shown in FIG. 4*b*, from the right end the sheet contains printed bands of cyan C, magenta M and yellow Y particles which were printed respectively during passage of the red, green and blue portions of the target through the imaging zone. The white line P*t*, or absence of pigment, on sheet S is a trace of the opaque point P (see FIG. 4*a*) where line M intersects the light strip 17.

Considering first the action zone information about the cyan particles, it can be seen that complete migration (i.e., migration to an extent resulting in deposition of particles on layer I) first occurred when the red target sector had progressed to a position R' (illustrated in dotted lines in FIG. 4*a*) edge *e'* being a distance X from center line A'. Thus the distance L*f* on the print to be analyzed (from the trace line P*t* to the initial print out point occurring during exposure by beam 17) can be used to calculate the distance X, the forward limit of the action zone of the cyan particles (in-mixture and a use environment).

The manner of such calculation is illustrated in FIG. 4*c*, which can be considered a top view of the apparatus of FIG. 4*a* with distance L*f* projected onto centerline A'. Knowing the distance L*f* and the angle $\alpha$, the distance X can be calculated according to $X = Lf \tan\alpha$. Referring to FIGS. 4*a*–4*c*, it will also be appreciated that the rearward action Y can be calculated similarly according to $Y = Lr \tan\alpha$, L*r* being measured as the distance below trace P*t* where the last migration occurs during exit from the imaging zone.

Other information can be obtained from the images on test sheets S. For example, FIG. 4*d* illustrates an enlarged illustration of the portion C of the test sheet shown in FIG. 4*b*. Sections $C_1$, $C_2$ and $C_3$ are indicated by dotted lines to exemplify zones of the actual cyan color image which may be of different color purity, i.e., inter-zones within the overall action zone in which differences in color due to effectiveness of particle migration can be strikingly observed. For example section inter-zone $C_2$ may be a highly pure cyan color with inter-zones $C_1$ and $C_3$ containing a less dense image or a less pure or "dirty" image caused by migration of other than cyan particles. Thus it can be seen that the analysis described can be used also to implement the present invention in a manner optimizing the order of separate color exposures to expose each particle type in its best purity zone. Similarly analysis can be made of the magenta and yellow bands on the test sheet S. Additionally, such tests can be made with neutral, cyan, magenta and/or yellow patches to detect the interactive properties of different sets of colored pigments.

Given the results of a test as described above, the separate color information sub-zones can be arranged to implement exposure in the most effective portion of the action zone for each particle type. To economize space within the overall imaging zone, it might be desirable to expose first the particle type having the leading action, e.g., first expose green image information to the magenta particles which exhibited the leading action zone in the test described above.

While arrangement of exposure in accordance with relative action zones and/or to obtain the best purity are desirable means of implementing the present invention, other desirable arrangements can be utilized to accomplish particular objectives in connection with the characteristics of a given dispersion mixture. Color balance corrections or spatial filtering, e.g., example based on observations of the different pigment sets, are such objectives. An exemplary arrangement of exposure not in accordance with decreasing action zone order is described later in the Examples, for a color balance improvement technique. Other objectives which can be achieved and will be described include arrangement in preferred order(s) for scattering characteristic and in order(s) to obtain least unwanted absorption.

Having now described the background and certain theoretical aspects of the invention, we will describe various structural embodiments which can be used to implement its practice; however it will be realized that the preferred embodiments hereinafter specifically described are not considered to be exhaustive of desirable and useful structures and procedures for practicing the invention.

Figure 5:
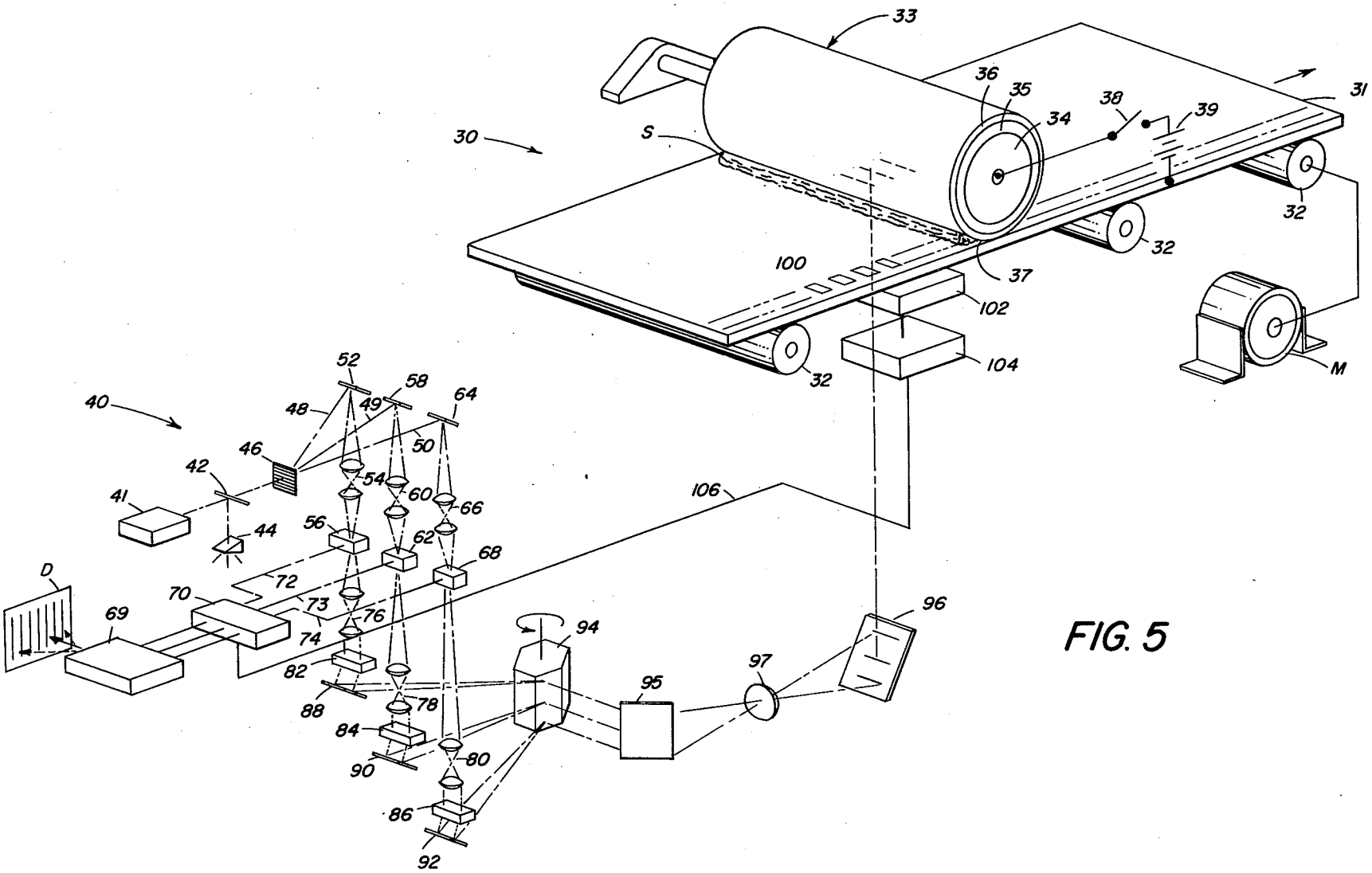
FIG. 5 is a partially schematic perspective view of a portion of an apparatus incorporating one embodiment of the present invention.

FIG. 5 illustrates schematically one advantageous means for implementing the invention; the portions of the apparatus shown in that Figure can be denoted generally as printing assembly 30 and exposing assembly 40. The printing assembly 30 is similar to that described with respect to FIG. 1 and includes an injecting electrode 31, in the form of a translating NESATRON glass plate (NESATRON is a trademark of PPG Industries used to designate an electrically conductive, transparent, indium-oxide glass plate), which is supported by conventional means not shown for translational drive in the plane indicated by motor M via rollers 32. The blocking electrode 33 can comprise a 4-inch diameter, resilient, electrically-conductive central roller 34 covered with a layer of electrically insulating material 35, such as a barium titanate (BaTiO3), overcoated with a protective layer 36 such as cellulose acetate. The blocking electrode 33 makes pressure contact and forms a nip 37 with the upper surface of the injecting electrode 31. The conductive core 34 of the blocking electrode 33 is connected through a switch 38 to a high voltage power source 39, the opposite side of which is coupled to injecting electrode 31.

A tri-color imaging suspension S is provided between electrodes 31 and 33 by conventional means, e.g., coating it on either the blocking electrode 33 or the injecting electrode 31 or by manual placement of a strip or "puddle" of the suspension behind the electrode 33 prior to commencement of the imaging sequence.

The imaging suspension S comprises a mixture of finely-divided, electrophotosensitive, magenta, cyan and yellow-colored pigment disposed in an insulating carrier liquid, the particles being selected as previously described (i.e., so that the cyan particles are primarily responsive to red light, the magenta particles are primarily responsive to green light, and the yellow particles are primarily responsive to blue light).

During the imaging procedure, the injecting electrode 31 is translated in the direction indicated and blocking electrode 33 rotates as indicated in response to translation of electrode 31. In the zone proximate nip 37 the suspension is subjected to the high voltage electric field of source 39. While under influence of that field, the imaging suspension S is exosed to activating electromagnetic radiation by the exposure assembly 40 in accordance with the present invention as described in more detail below. A multicolor positive image of the original is formed on the injecting electrode 31 and a complimentary multicolor negative image is formed on the blocking electrode 33.

Once such images are formed on the electrodes 31 and 33, they may be fixed thereon, for example by spraying with a binder material or by laminating an overlay thereover, or the images may be transferred from the electrodes and fixed on another surface. Such a transfer step may be carried out, e.g., by pick-off with an adhesive tape or by electrostatic field transfer to a paper sheet as is well known in the xerographic art.

The exposure assembly 40 shown in FIG. 5 includes a source of multicolor electromagnetic radiation, e.g., a Krypton ion laser, Coherent Radiation Laboratories, Inc., Model 52. The laser 41 generates a single beam including the color components red [at 697.1 nanometers (nm)], green (at 520.8 nm) and blue (at 476.2 nm).

The output beam of the laser 41 passes through a 45° beam splitter 42, and approximately 8% of the beam is reflected by the beam splitter through a prism 44 which separates the reflected portion of the beam into its red, green and blue spectral components. The red, green and blue components are then reflected by a mirror (not shown) to three photodiodes (not shown) which provide output signals to control the energy output of the laser 41 in the three wavelength bands in a manner known in the art.

The remaining 92% of the beam from laser 41 is transmitted by the beam splitter 42 and passes through a diffraction grating 46 which separates that beam into its blue, green and red spectral components 48, 49 and 50, respectively. The blue component of the beam 48 is reflected by a mirror 52 to a lens system 54 which filters the beam wavelengths and focuses the beam onto an acoustooptic modulator cell 56. Similarly, the green component of the beam 49 is reflected by a mirror 58 to a lens system 60 which filters and focuses the beam onto an acoustooptic modulator cell 62 and the red component of the beam 50 is reflected by a mirror 64 to a lens system 66 which filters and focuses the beam onto an acoustooptic modulator cell 68.

The original document D to be reproduced is optically scanned, e.g., by a device 69 such as is disclosed in U.S. Pat. No. 3,783,185; and electrical signals representative of the blue, green and red information content of successive discrete protions thereof are fed to a signal processor 70, e.g., of the type disclosed in U.S. Pat. application Ser. No. 740,699 entitled "DOCUMENT COPYING APPARATUS", filed Nov. 11, 1976 in the name of J. H. Ladd, the disclosure of which is hereby incorporated by this reference. The processor 70 outputs blue, green and red control signals to modulate the amplitudes of three 80-megahertz UHF carrier signals 72, 73 and 74, respectively, and the three modulated carrier signals are amplified and applied to the modulator cells 56, 62 and 68 for controlling intensity modulation of the blue, green and red printing beams 48, 49 and 50, respectively. From the modulator cells 56, 62 and 68, the beams 48, 49 and 50 pass through lens systems 76, 78 and 80, respectively, which control the beams' size to the appropriate diameters.

The expanded beams 48, 49 and 50 are then directed to glass refraction blocks 82, 84 and 86, respectively, which function to deflect the beams' path. By thus controlling the beam deflection, the order in which the beams 48, 49 and 50 expose the imaging suspension S in the nip 37 can be varied and the position in the nip whereat such exposure occurs can be individually adjusted. The size of the beams can be selectively controlled by the apparatus optical system, as mentioned, or by the provision of mask elements along the optical path.

The diffracted beams 48, 49 and 50 emerging from the refraction blocks 82, 84 and 86, respectively, are directed by stationary plano mirrors 88, 90 and 92, respectively, onto a multi-faceted spinning mirror 94 which scans the laser beams across mirrors 95 and 96. Mirror 96 directs the beams into the exposing zone of printer 30 and lens 97 images the beams at the plane of the dispersion between the electrodes.

As will be understood by those skilled in the art, the paths of the point-by-point scan across the suspension at the imaging zone, indicated schematically by the dotted lines in FIG. 5, must be in timed relationship with the movement of the suspension, injecting electrode 31 and blocking electrode 33 through the imaging zone, so that the relative position of each discrete image portion migrating to the electrode surfaces corresponds to the relative position of its counterpart portion of the original document. To provide such synchronization, perforations 100 can be provided along an edge of the injecting electrode 31 and sensed during movemnt over sensor 102. Signals from sensor 102 are applied to a logic and control unit 104, which is adapted to determine the rate of movement of electrodes 31 and 33 and provide signals indicative of this rate to the signal processor 70. An example of a logic and control apparatus which can perform the aforementioned operation is set forth in detail in U.S. Pat. No. 3,914,047 entitled "SYNCHRONIZING CONTROL APPARATUS FOR ELECTROPHOTOGRAPHIC APPARATUS USING DIGITAL COMPUTER", issued to Hunt et al on Oct. 21, 1975, the disclosure of which is incorporated herein by reference.

Referring now to FIG. 3, as well as FIG. 5, it will be appreciated that the apparatus of FIG. 5 provides a highly advantageous embodiment for implementing spatial, color separation exposures in accordance with the present invention. Thus, the width of each of the red, green and blue exposure beams 48, 49 and 50 from laser source 41 can be adjusted in width by the optical system of assembly 40 to conform to the desired width of the red, green and blue information zones shown in FIG. 3. Further, the order and relative separation of the red, green and blue line exposures can be adjusted, as well as the distance of such exposures from the normal projection of the roller's center line axis.

If the red, green and blue color information from scanning device 69 is input simultaneously to processor 70 for each discrete image portion comprising a given line scan of the original document, processor 70 can incorporate appropriate storage or delay means to sequence the output of color modulating information to the exposing laser beams in proper timed relation with movement of the suspension and electrodes. That is, the red information pertaining to the image portions on a given line of the orignal first will be outpout to modulator 68 during line scan of the red laser beam with the corresponding line of the suspension and electrodes at the red information zone. The green information pertaining to the same given line will be output subsequently during a line scan of the green laser beam after the corresponding line of the suspension and electrodes has moved to the green information zone, etc. One skilled in the art will realize that the need for such delay circuitry can be obviated by providing a sequential red, green and blue information scan of each given line original, for example by moving the document (physically or optically) past spaced electrophotosenstive sensors selectively sensitive to red, green or blue light, e.g., filtered photocells or charge coupled device arrays.

Color balance compensations can be effected automatically (or selectively variable adjustment can be implemented) by controlling the intensity of the laser beams, e.g., in accordance with techniques of the aforementioned Ladd application or by conventional adjustment circuitry coupled to the feedback device receiving output from prism 44.

Figures 6, 7:
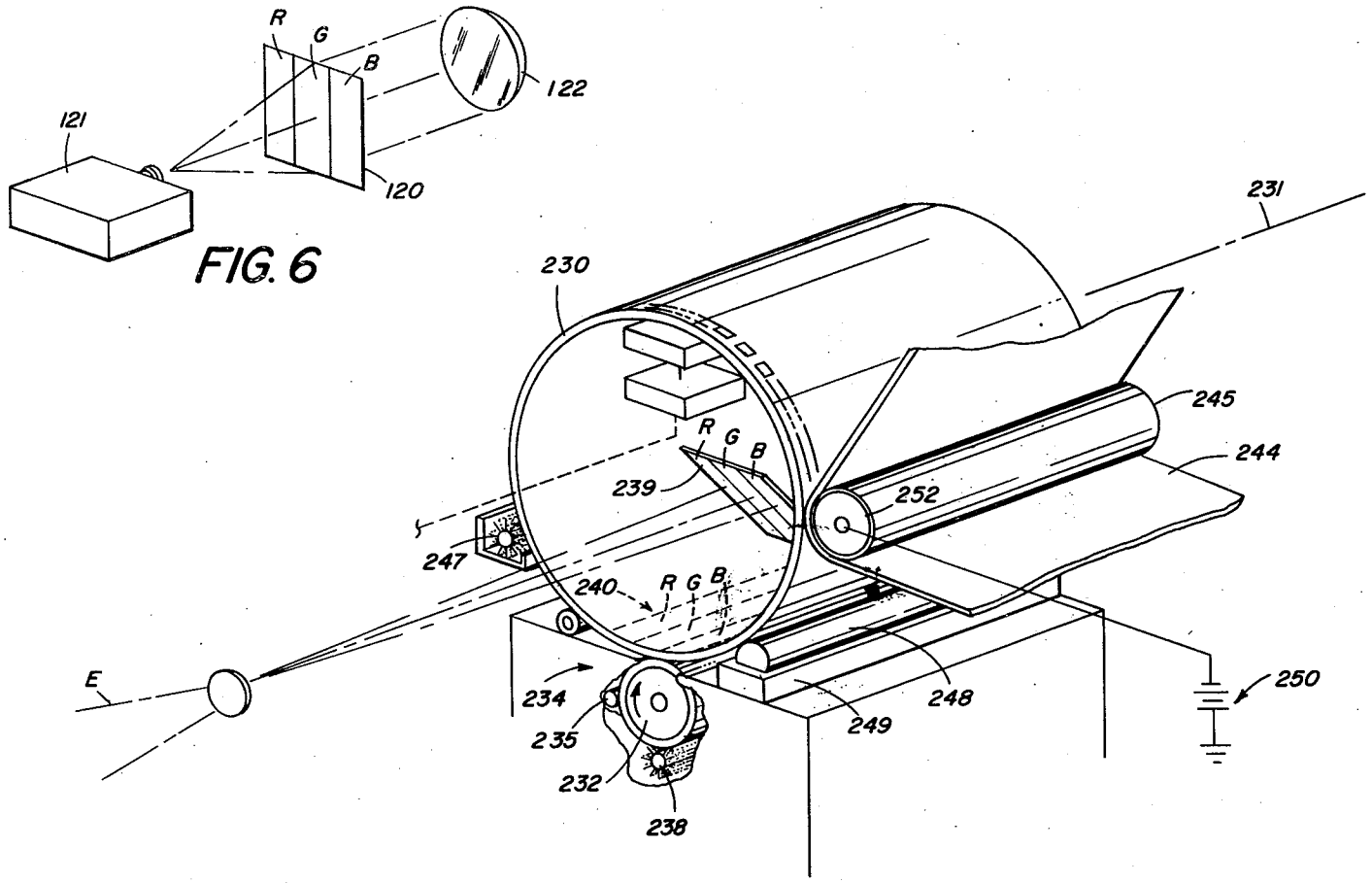
FIG. 6 is a perspective view of exposure apparatus useful in apparatus in accordance with another embodiment of the present invention.
FIG. 7 is a perspective view of a continuous output apparatus utilizing an embodiment of the present invention.

FIG. 6 discloses a simplified embodiment for practicing the spatial color separation exposures in accordance with the present invention. In this embodiment, a tricolor filter 120 is interposed in the optical path of a multicolor color original image projected into the exposure zone of a photoelectrophoretic printing apparatus (not shown). The red, green and blue filter sections of element 120 will be sized and arranged in accordance with the order and desired extent of the red, green and blue information zones at the imaging zone of the printing apparatus and located in the optical path, e.g., between a transparency being projected from projector 121 and field lens 122. Of course, the filter can be located in any operable location along the optical path, including adjacent the original or the print station, its size varying in accordance with the selected location along the optical path. Also, it will be understood that the intercepted and spatially color-separated light image can be a reflection image from an opaque color original, as well as a projected transparency. Since a desirable implementation of the present invention is in a continuous operation mode, it may be desirable to provide means for moving the original image in an optically complementary manner to the movement of the suspension and electrodes of the printing apparatus. Conventional mirror and lens scanning systems can be used or, as in apparatus 121, means (not shown) can be provided to move the original in proper timed relation with the abovementioned elements of the printing apparatus.

FIG. 7 shows a continuous electrophoretic migration imaging apparatus which can utilize the laser exposure system of FIG. 5 or the filter system shown in FIG. 6. In this embodiment, the injecting electrode 230 is in the form of a hollow, cylindrical NESATRON glass drum (NESATRON is a trademark of PPG Industries, Inc., used to designate an electrically conductive glass formed with sputtered InO) mounted for rotation about central axis 231 in a counterclockwise direction as shown in FIG. 7, and rotated by conventional motor and drive means, not shown. The blocking electrode 232, which is of the same construction as the blocking electrode 33 of FIG. 5, is mounted for rotation within a reservoir 234 positioned below the injecting electrode 230. The blocking electrode 232 rotates in a clockwise direction with its peripheral surface passing into and out of the imaging suspension contained in the reservoir 234 and past a metering roller 235, which is designed to provide a smooth, uniform layer of imaging suspension between the electrodes at the imaging zone 240.

An exposure system E, constructed in accordance with the present invention, directs color-separation information to the information zones R, G and B via mirror 239, forming a positive image on the injecting electrode 230 and a cmplementary negative image on the blocking electrode 232. An electric field of the type described is provided between the electrodes 230 and 232 during the image exposure of the suspension. The positive image formed at the imaging zone is carried by rotation of the injecting electrode 230 into contact with a receiver sheet 244, which is driven about a transfer roller 245 in the same direction and at the same speed as the injecting electrode 230. Before the positive image on electrode 230 contacts the receiver sheet 244, it is moistened with a transfer-assisting liquid by a wetting roller 248 which rotates in a reservoir 249 containing the wetting liquid. The transfer roller 245 consists of an inner electrically conductive core connected to a high-voltage power source 250 and covered with an outer layer of resilient electrically conducting material 252. The voltage source 250 biases the receiver sheet 244 to a polarity opposite that of the pigment particles on the injecting electrode 230 to facilitate transfer of the pigment to the sheet. The transferred image can then be fixed in place on the receiver sheet 244, utilizing one of several techniques well-known in the art. The remnants of the positive image remaining on the injecting electrode 230 are removed by a brush 247 in preparation for the next imaging cycle and the negative image on the blocking electrode 232 is removed by brush 238.

The following description of detailed working examples of the present invention will provide further teachings of practice and advantages.

EXAMPLE 1

An improved three-color print was made utilizing the apparatus shown in FIG. 4*a* with a Carousel slide projector, manufactured by Eastman Kodak Company as the light source. A multicolor filter, such as described with respect to FIG. 6, was used and comprised narrow, adjacent strips of Eastman Kodak Company Wratten Filters No. 47 (blue), No. 61 (green) and No. 29 (red). The widths of the three filter strips were about 1 mm., 0.75 mm. and 0.5 mm., respectively, and the strips were interposed in the optical path so as to project at the imaging zone with a magnification of about 1.

A tricolor imaging suspension was prepared by ball-milling cyan, magenta and yellow color pigments separately with a charge control agent in Solvesso 100 (a trademark of the Humble Oil Company used to designate a hydrocarbon s olvent having a boiling point of 160°–174° C.), diluting the pigments to 2% by weight with a 40% solution of Piccotex 100/Isopar G® (trademarks used to designate a styrene-vinyl toluene copolymer from Pennsylvania Industrial Chemcial Corp. and an isoparaffinic aliphatic hydrocarbon liquid from Exxon Corp., respectively), and then combining the three color dispersions by mixing. The cyan, magenta and yellow pigments used to prepare the pigment dispersions were Cyan Blue GTNF (from Americal Cyanamid Co.), Sandorin Brilliant Red 5Bl (from Sandoz Corp.) and 9,10-Bis[4-di-4-tolylamino styryl]anthracene, respectively.

The dispersion was positioned in the nip ahead of the electrodes and the positions of the filtered light bands were adjusted so that the downstream edge of the projected image of the blue filter was aligned with the center line of the blocking electrode roller axis and extended to the left as shown in the drawing (i.e., so that the filter zones extended ahead of the center line). The green filter zone was positioned next to (i.e., ahead of) blue filter zone and the red filter zone was positioned next to (i.e., ahead of) the green filter. A Kodak Wratten No. 2B Filter was placed across all portions of the light beam to eliminate the ultraviolet portion of the spectrum, and the light was blocked off on either side of the filter strips by a mask. With the light source on, the injecting electrode, carrying on its back surface a color negative transparency consisting of green, red and blue color patches, was moved at a rate of 8 cm./sec. while a 1-kv. voltage was applied between the electrodes. The white-light intensity of the beam entering the filter was approximately $2 \times 10^3$ footcandles. The resulting negative-to-positive print produced on the insulating layer of the blocking electrode consisted of cyan, magenta and yellow color patches corresponding to the red, green and blue color patches of the original. The red, green and blue reflection densities of these cyan, magenta and yellow patches were 0.6, 0.5 and 0.7, respectively. A control print was then made by the above-described procedure with a 1.0 neutral density filter replacing the three-color filter. The resulting red, green and blue reflection densities of the cyan, magenta and yellow color patches formed on the insulating layer of the blocking electrode were 0.6, 0.5 and 0.3, respectively. A visual comparison of the two prints showed a significant improvement in the color quality of the print made using the tricolor, spatial filter due to the large increase in the blue image density (i.e., the increased quantity of blue-light-absorbing, yellow pigment on the print).

EXAMPLE 2

A tricolor imaging suspension was prepared according to the procedure described in Example 1, except that the cyan, magenta and yellow pigments were Monofast Blue G (from the H. Kohnstamm Co.), Sandorin Brilliant Red 5BL (from the Sandoz Corp.) and 9,9'-[2,6-naphthyl-bis-ethylene]bis-julolidine, respectively. The three color dispersions were combined so that the suspension contained equal volumes of a 2% cyan pigment dispersion, a 4% magenta pigment dispersion and a 2% yellow pigment dispersion.

Figure 8A:
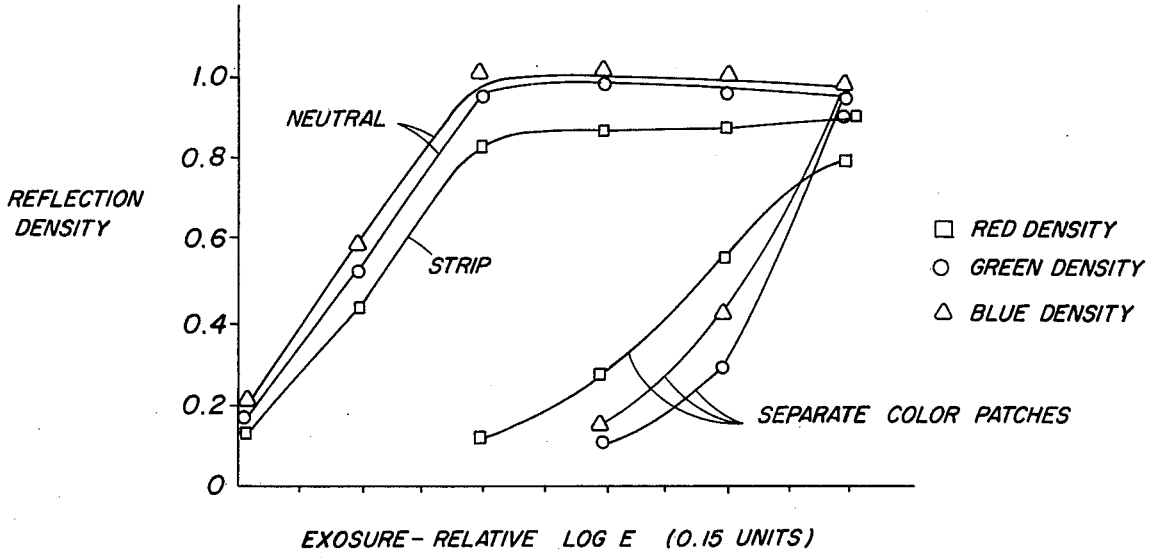
FIGS. 8*a* and 8*b* are graphs showing test results indicating improvements incident to use of the present invention.
Figure 8B:
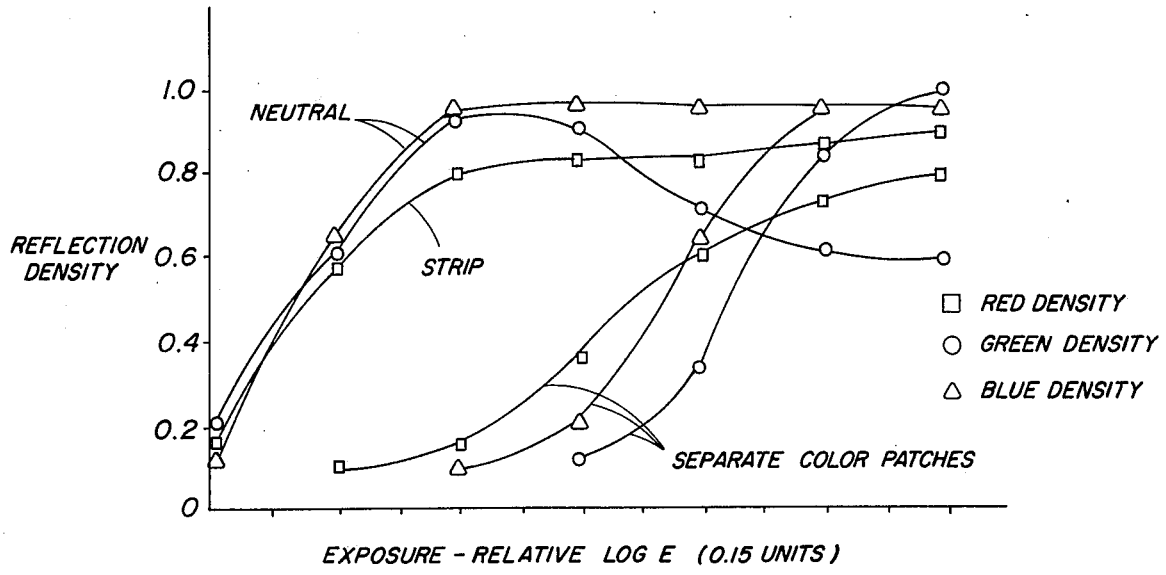

A three-color, negative-to-positive print was produced, utilizing the apparatus and procedure described in regard to Example 1, except that the tricolor filter was replaced by a mask having a 4-mm.-wide projection slit with a 2.5-mm.-wide strip thereof covered with a Kodak Wratten No. 61 (green) Filter. The position of the projected image of the slit was adjusted so that the downstream edge of the white-light slit was superimposed with the center line of the blocking electrode roller axis and the remainder extended ahead of the center line. The projected image of the green filter was positioned adjacent the upstream edge of the white-light image so that the green exposure of the suspension preceded the white-light exposure. The original was a test object placed on the back surface of the injecting electrode and consisted of a 0.3 neutral density step wedge laid at right angles to red, green, blue and clear film strips. The exposure beam was a 3-kfc. tungsten source filtered with a Kodak Wratten No. 2A Filter, a 665-nm. interference cutoff filter and two Kodak color compensating filter: a cc 50 cyan and a cc 30 blue. The 900-volt potential applied across the electrodes produced a current flow of about 10 microamps across the 5-cm.-wide injecting electrode. The negative-to-positive print formed on the insulating layer of the blocking electrode was adhesively transferred with transparent tape to a paper support. The graph of FIG. 8*a* shows the characteristic curves for the print produced by the above procedure. A control print was then made by the above-described procedure but with the 2.5-mm. strip of Kodak Wratten No. 61 filter removed from the white-light exposure slit. The graph of FIG. 8*b* shows the same characteristic curves for the print exposed without the Kodak Wratten No. 61 filter. In each of the graphs, the red, green and blue reflection densities of the neutral strip, as well as the reflection densities of each of the separate colors, are plotted. As shown in FIG. 8*b*, the print exposed without the Kodak Wratten No. 61 filter shows a green "drop-off" of the neutrals at high exposure levels. Thus, in accordance with prior art techniques, the exposure of that print could be adjusted to obtain an image having saturated single colors with a "green" neutral or to obtain a good neutral with desaturated single colors. In FIG. 8*a*, the curves for the print produced with spatial green and white-light exposure show the red, green and blue reflection density curves for the neutral strip are nearly parallel to each other, resulting in a good i.e., well color-balanced, neutral and without substantial decrease in Dmax of the separate color patches. Thus, it can be seen that spatial color exposure provides images having good separate color Dmax, as well as a blackappearing neutral Dmax. This improved procedure using a form of spatial separation color exposure which could be denoted spatial filtering allows imaging to be adjusted so that both saturated single colors and saturated neutral can coexist in a given print.

EXAMPLE 3

A three-color, negative-to-positive print was produced by exposing a tricolor imaging suspension in a single imaging zone to three laser beams of different color operating in spaced sub-zones. The apparatus used in this example was functinally the same as that shown in FIG. 5, the major difference being that three individual lasers, each producing an output beam of a differnet color, were employed in place of the single laser and diffraction grating. The use of three separate lasers (one krypton ion laser and two argon ion lasers) permitted greater flexibility and ease in adjustment of the wavelength and power levels of the laser beams.

The test image generated by the signal processor and applied to the beam modulators consisted of 64 sensitometric patches including minus red (cyan), minus green (magenta), minus blue (yellow) and a neutral patch. The speed of rotation of the spinning mirror, the number of mirror facets used, the spatial separation of the three laser beams and the translational speed of the injecting electrode were adjustable parameters used to control the amount of overlap of the scanned laser lines. These parameters were adjusted to produce about 7-mm.-square patches at the imaging zone. The laser scan lines were slightly overlapped (i.e., at the $1/e^2$ to 40% points on the gaussian beam spread function). Prints were produced using three different imaging suspensions, and three of the possible six combinations of ordering the three laser beams were tested. Control prints were also produced from the imaging suspensions with the three laser beams superimposed. Pertinent data for the production of these three prints are listed below:

EXPOSURE (a) The laser-beam wavelength and power levels were:

Blue-457.9 nm. at about 200 mW.
Green-528.7 nm at about 200 mW.
Red-647.1 nm. at about 500 mW.

(b) For spatially separated exposure, the laser scan were 50 to 75 micrometers wide and the first, second and third beam positions were, respectively, 1.9 mm., 1.3 mm. and 0.6 mm. ahead of the normal extension on the injecting electrode of the central axis of the blocking electrode, i.e., $A^1$ in FIG. 4*a*. For superimposed exposure, 50 to 75 micrometer wide scan lines were all positioned 1.3 mm. ahead of the central axis projection in a first test and on the axis in a second test.

(c) The injecting electrode's translational velocity was about 2.5 cm./sec.

(d) Every fourth facet of a faceted mirror spinning at 15,000 rev./min. was used.

Printer (a) A negative 500 volts was applied to an 11-cm.-wide injecting electrode which produced a current flow while exposing of approximately 20 microamperes.

Imaging Suspensions

The imaging suspensions were prepared according to the procedure described in Example 1, using the following pigments:

| | |
|---|---|
| Suspension No. 1: | |
| cyan pigment | Cyan Blue GTNF |
| magenta pigment | Sandorin Brilliant Red 5BL |
| yellow pigment | 6,6'-[2-6-naphthylene-divinylene]-bis[N-ethyl-1,2,3,4-tetra-hydroquinoline] |
| Suspension No. 2: | |
| cyan pigment | Cyan Blue GTNF |
| magenta pigment | Sandorin Brilliant Red 5BL |
| yellow pigment | 9,9'-[2,6-naphthyl-bis-ethylene]-bis-julolidine |
| Suspension No. 3 | |
| cyan pigment | Cyan Blue GTNF |
| magenta pigment | Sandorin Brilliant Red 5BL |
| yellow pigment | 9,9'-[p-phenylene-bis-ethylene]-bis-julo-lidine |

The suspensions were coated on the injecting electrode, using a 50 micrometer doctor blade.

Observations

With exposure using spatially separated laser beams, a force layering of the different color pigments was observed in accordance with the order of exposure of the laser beams. With exposure using superimposed laser beams, layering of the different color pigments was either nonexistent or dependent upon the particular imaging suspension used. The layering observations were made by measuring the color reflection densities of the residual color pigments remaining on the blocking electrode after a single adhesive transfer was made therefrom. Tabulated below in Table 1 are data pertaining to the neutral density patch and the red, green and blue patches (i.e., images formed on the blocking electrode by the green and blue, blue and red and red and green programmed laser beams respectively.

TABLE 1

Residual Color Reflection Densities

| Suspension No. | Order of Laser Lines (mm. ahead of roller axis) | | | Reflection Density of Remaining Pigment after First Transfer (color patch) | | | | | | | | |
|---|---|---|---|---|---|---|---|---|---|---|---|---|
| | 1.9 | 1.3 | 0.6 | Neutral | | | Red | | Green | | Blue | |
| | R | B | G | R | G | B | B | G | R | B | R | G |
| 1 | | | | 0.4 | 0.2 | 0.2 | 0.2 | 0.2 | 0.2 | 0.1 | 0.5 | 0.3 |
| 2 | | | | 0.3 | 0.2 | 0.2 | 0.2 | 0.2 | 0.3 | 0.1 | 0.3 | 0.2 |
| 3 | | | | 0.4 | 0.2 | 0.3 | 0.2 | 0.3 | 0.3 | 0.2 | 0.3 | 0.3 |
| | G | B | R | G | B | R | G | B | B | R | G | R |
| 1 | | | | 0.4 | 0.2 | 0.2 | 0.5 | 0.3 | 0.3 | 0.2 | 0.3 | 0.2 |
| 2 | | | | 0.3 | 0.2 | 0.2 | 0.2 | 0.1 | 0.2 | 0.2 | 0.3 | 0.2 |
| 3 | | | | 0.4 | 0.3 | 0.2 | 0.3 | 0.1 | 0.3 | 0.2 | 0.4 | 0.2 |
| | B | G | R | B | G | R | B | G | B | R | G | R |
| 1 | | | | 0.3 | 0.3 | 0.2 | 0.3 | 0.2 | 0.4 | 0.2 | 0.5 | 0.3 |
| 2 | | | | 0.3 | 0.3 | 0.2 | 0.2 | 0.2 | 0.2 | 0.2 | 0.3 | 0.2 |
| 3 | | | | 0.3 | 0.4 | 0.3 | 0.2 | 0.2 | 0.2 | 0.2 | 0.3 | 0.2 |
| | superimposed at 1.3 mm. | | | R | B | G | B | G | R | B | R | G |
| 1 | | | | 0.3 | 0.3 | 0.3 | 0.3 | 0.2 | 0.3 | 0.2 | 0.4 | 0.3 |
| 2 | | | | 0.4 | 0.3 | 0.3 | 0.2 | 0.2 | 0.3 | 0.3 | 0.3 | 0.3 |
| 3 | | | | 0.4 | 0.3 | 0.3 | 0.2 | 0.2 | 0.4 | 0.3 | 0.4 | 0.3 |
| | superimposed on axis | | | | | | | | | | | |
| 1 | | | | 0.2 | 0.2 | 0.3 | 0.2 | 0.2 | 0.2 | 0.1 | 0.3 | 0.3 |
| 2 | | | | 0.2 | 0.2 | 0.3 | 0.1 | 0.2 | 0.2 | 0.2 | 0.2 | 0.3 |
| 3 | | | | 0.3 | 0.3 | 0.3 | 0.2 | 0.3 | 0.2 | 0.2 | 0.3 | 0.3 |

By referring to the tabulated data in the table, it can be seen that, with the imaging suspensions numbers 1 and 2 and spatially separated exposure, the magnitude of the color reflection densities in the residual patches corresponds to the order of color laser exposure. For example, in a residual neutral patch the highest density corresponds to the color of the first laser exposure beam to expose the suspension, the next highest density corresponds to the color of the second laser beam to expose the suspension, and the lowest density corresponds to the color of the third laser beam to expose the suspension. That is, if the order of exposure is green, blue and red, then the green density (quantity of magenta pigment) of the residual image is highest, the blue density is next, and the red density is the lowest. This means, possibly, that the magenta pigments arrived at the insulating layer first, then the yellow pigments, and finally the cyan pigments. The data for imaging suspension number 3 indicate that, with spatially separated exposure, pigment layering was achieved, but that such layering did not always correspond to the order of color laser exposure.

With superimposed laser exposure at a point 1.3 mm. ahead of the roller axis, the data show that the color reflection densities in the residual patches may have a tendency to follow a "native" ordering of cyan pigments arriving first followed by yellow and then magenta, apparently related to the speed (mobility) of the different color pigment particles utilized in the particular imaging suspensions. With superimposed laser exposure on axis, the data on the color reflection densities in the residual patches appear substantially random. The definite layering evidenced can be useful in controlling scattering characteristics of a print formed from a given mixture and/or in arranging pigment layers on the print to obtain the least unwanted absorption.

The foregoing examples provide teachings of certain ways in which the present invention can be used to improve photoelectrophoretic reproduction apparatus and techniques. It will be appreciated that other useful modes of, and purposes for, arranging spaced, color-separation sub-zones within an imaging zone will occur to those skilled in the art, as will other structural means for implementing such improved procedures.

Thus, although the invention has been described in detail with particular reference to preferred embodiments thereof, it will be understood that variations and modifications can be effected within the spirit and scope of the invention.

What is claimed is:

1. Improved apparatus for producing electrophoretic migration color images at an exposure station, said apparatus comprising:

(a) means for supporting an image receiver at said exposure station;

(b) means for providing contiguous a supported receiver a mixture containing electrophotosensitive color particles of at least two color types;

(c) means for producing a migration-inducing field across said mixture; and (d) means for sequentially exposing the mixture within such field to imagewise light, initially of a first color to which one of said particle types is sensitive and thereafter of a second color to which the other of said particle types is sensitive.

2. The invention defined in claim 1 wherein said exposure means comprises means for scanning discrete portions of the overall image to be reproduced in succession onto corresponding discrete successive portions of the particle mixture contiguous such receiver and wherein said first and second color exposures of each given mixture portion are spatially separated.

3. In printing apparatus of the type including means for producing a migration-inducing field, means for providing in said field a mixture containing at least first and second types of electrophotosensitive color particles responsive respectively primarily to light in first and second wavelength bands, and means for exposing said mixture with light in such wavelength bands in an imagewise pattern representing a desired print, the improvement wherein said exposing means effects the imagewise exposure of each given mixture portion by light of such first wavelength band before the imagewise exposure of that given portion by light of said second wavelength band.

4. The invention defined in claim 3 wherein said exposure means includes means for controlling the periods for which each given portion is subjected to the different wavelength bands.

5. The invention defined in claim 4 wherein said exposing means includes scan means for successively imaging discrete segments of an original onto successive segments of such dispersion at an imaging zone and said period regulating means includes means for providing exposure by said first and second wavelength bands in spatially separated subzones, within said imaging zone.

6. The invention in claim 3 wherein the exposure of each portion of said dispersion to said first and second wavelength band occurs in spatially separated exposure zones.

7. In color printing apparatus of the type including a pair of electrodes, means for supporting said electrodes with at least portions thereof in closely spaced relation, means for providing a migration-inducing electrical field between such electrode portions, means for providing between said electrode portions an electrophotosensitive particle dispersion including at least two particle types respectively primarily-sensitive to light in first and second color wavelength bands, and means for exposing dispersion within such field with an image comprised of information of both said wavelength bands, the improvement comprising means for controlling the exposure of said image information so that the image information of said second wavelength band is imparted to its respective particle type in sequence after the corresponding image information of said first wavelength band is imparted to its respective particle type.

8. The invention defined in claim 7 wherein said exposing means imparts the overall image information in successive information increments and said controlling means includes means for providing time-sequential input of corresponding pattern information increments by said first and second wavelength bands.

9. The invention defined in claim 8 wherein said successive information increments are defined by movement of successive portions of said electrodes and the dispersion therebetween past an imaging zone and said controlling means provides spatially separate sub-zones for input of information of said first and second wavelength bands.

10. The invention defined in claim 9 wherein said exposing means includes a source of multiwavelength light, means for directing light from said source along a light path to said imaging zone, and filter means interposed in said light path for passing separate beams of light of said first and second wavelengths respectively to said sub-zones.

11. The invention defined in claim 9 wherein said exposing means includes means for producing beams of radiation of each of said different wavelength bands, means for directing said beams respectively across said separate subzones, and means for discretely modulating the intensity of each beam in accordance with the content of the image to be reproduced.

12. A migration imaging apparatus comprising in combination;

(a) two spaced electrodes adapted to receive therebetween an imaging layer comprising a mixture of at least first and second electrically photosensitive particles, each of said first and second particles being of a different color and sensitive to light of predetermined, different wavelengths, one of said electrodes being at least partially transparent to light in the visible region of the spectrum, one of said electrodes bearing an electrically-insulative layer on the surface thereof;

(b) means to apply an electric field across said imaging layer; and (c) means for exposing said imaging layer through said transparent electrode to a multicolored pattern of activating radiation at an imaging zone, said exposing means comprising means for providing at least two spatially separated beams of light respectively of two different wavelengths, said first photosensitive particles being sensitive to light of one of said wavelengths and said second photosensitive particles being sensitive to light of the other of said wavelengths.

13. An imaging apparatus as defined in claim 12 wherein at least one of said electrodes is a roller.

14. An imaging apparatus as defined in claim 12 wherein at least one of said electrodes is a substantially flat plate.

15. An imaging apparatus as defined in claim 12 wherein said electrode bearing said insulative layer is a roller and moves said layer into and out of contact with said imaging layer at said imaging zone in the presence of said electric field and said imagewise exposure.

16. An imaging apparatus as defined in claim 12 wherein said exposing means comprises laser means providing a first output comprised substantially of wavelengths of light to which said first photosensitive particles are sensitive and a second output comprised substantially of wavelengths of light to which said second photosensitive particles are sensitive.

17. An imaging apparatus as defined in claim 12 wherein said exposing means comprises a source of white light projected and at least two spatially separated filters which transmit respectively, wavelengths of light to which said first and second photosensitive particles are respectively sensitive.

18. A migration imaging apparatus comprising:

(a) a substantially optically transparent first electrode;

(b) a second electrode adapted to contact said first electrode at an imaging zone;

(c) means to provide between said electrodes, at said imaging zone, an imaging suspension comprising a mixture of particles of at least first and second colors dispersed in an electrically-insulating carrier liquid, each of said particles comprising an electrically-photosensitive pigment whose principal optical absorption band coincides with its principal photosensitive response;

(d) means to apply an electric field between said electrodes at said imaging zone; and (e) means for exposing said imaging suspension to a multicolored image pattern at said imaging zone, said exposing means comprising at least two spatially separated beams of light of different wavelengths to which said particles are responsive.

19. An imaging apparatus as defined in claim 18 wherein said beams expose said suspension in sub-zones of width in range of about 1 mm. to about 2 mm.

20. An imaging apparatus as defined in claim 19 wherein the width of said sub-zones are different.

21. An imaging apparatus as defined in claim 18 wherein one of said electrodes is a roller mounted for rotating contact with successive portions of the other of said electrodes and said imaging zone is located proximate one edge of the area of contact between said electrodes.

22. An imaging apparatus as defined in claim 18 wherein said exposing means comprises a laser means providing a first output comprised substantially of wavelengths of light to which particles of said first color are responsive and a second output comprised substantially of wavelengths of light to which particles of said second color are responsive.

23. An imaging apparatus as defined in claim 18 wherein said exposing means comprises a source of panchromatic light projected and two spatially separated filters which respectively transmit wavelengths of light to which particles of said first and second colors are respectively responsive.

24. A migration imaging apparatus comprising:

(a) a substantially optically transparent first electrode and a second electrode, said electrodes being configured and supported so as to facilitate their relative movement in a manner providing contact between discrete successive imaging areas thereof;

(b) means for introducing between said imaging areas an imaging suspension including a mixture of cyan-colored particles which are principally photosensitive to red light, magenta-colored particles principally photosensitive to green light and yellow-colored particles principally photosensitive to blue light dispersed in an electrically insulating carrier medium;

(c) means for creating successively an electric field across the suspension between said successive imaging areas; and (d) means for exposing the suspension between said successive imaging areas with the red, green and blue light information of a multicolor original respectively at spatially separated red, green and blue information sub-zones within said imaging areas.

25. An imaging apparatus as defined in claim 24 wherein said exposing means comprises laser means providing a first output comprised substantially of wavelengths of red light, a second output comprised substantially of wavelengths of green light and a third output comprised substantially of wavelengths of blue light and means for modulating the intensity of said light outputs in synchronization with said successive imaging areas and in accordance with the information on the original.

26. An imaging apparatus as defined in claim 24 wherein said exposing means comprises a source of white light and three spatially separated filters which transmit red, green and blue light, respectively to said red, green and blue information sub-zones.

27. A method of reproducing a multicolor image pattern comprising:

(a) providing an imaging mixture including at least first and second electrically photosensitive particle types, said particle types being of different color and having correspondingly different spectral sensitivity;

(b) introducing such mixture between two spaced electrodes, one of which is at least partially transparent to visible radiation;

(c) establishing migration inducing field between said electrodes and across the mixture therebetween; and (d) exposing the mixture at an imaging zone located within said field sequentially to color-separation components of said image pattern.

28. The invention defined in claim 27 wherein the exposure of each of the color separation components occurs at a spatially separated sub-zone within said imaging zone.

29. In a method for color imaging wherein an imaging mixture having at least first and second of particle types, respectively of first and second colors and primarily electrically photosensitive to light of first and second wavelength bands, is disposed between two spaced electrodes, subjected to a migration-inducing electric field and exposed to an image pattern comprising said first and second wavelength bands, the improvement wherein each portion of said mixture is exposed to the image pattern light of said first wavelength band before its image pattern exposure to light of said second wavelength band.

30. The imaging method as defined in claim 29 wherein the exposure of each given mixture portion to the image pattern of light of said first wavelength band is spatially separated from its image pattern exposure by light of said second wavelength band.

* * * * *